US010384256B2

(12) United States Patent
Takahashi et al.

(10) Patent No.: US 10,384,256 B2
(45) Date of Patent: Aug. 20, 2019

(54) TOOLING FOR PUNCHING STEEL SHEET AND PUNCHING METHOD

(71) Applicant: NIPPON STEEL & SUMITOMO METAL CORPORATION, Tokyo (JP)

(72) Inventors: Yuzo Takahashi, Tokyo (JP); Osamu Kawano, Tokyo (JP); Tatsuo Yokoi, Tokyo (JP); Junji Haji, Tokyo (JP); Satoshi Horioka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 638 days.

(21) Appl. No.: 15/026,827

(22) PCT Filed: Nov. 11, 2014

(86) PCT No.: PCT/JP2014/079887
§ 371 (c)(1),
(2) Date: Apr. 1, 2016

(87) PCT Pub. No.: WO2015/072465
PCT Pub. Date: May 21, 2015

(65) Prior Publication Data

US 2016/0243606 A1 Aug. 25, 2016

(30) Foreign Application Priority Data

Nov. 13, 2013 (JP) ..... 2013-234491

(51) Int. Cl.
*B21D 28/26* (2006.01)
*B21D 28/34* (2006.01)

(52) U.S. Cl.
CPC ..... *B21D 28/26* (2013.01); *B21D 28/34* (2013.01)

(58) Field of Classification Search
CPC ..... B21D 28/00; B21D 28/02; B21D 28/26; B21D 28/34; B21D 24/16
See application file for complete search history.

(56) References Cited

U.S. PATENT DOCUMENTS

2014/0047890 A1* 2/2014 Flehmig ..... B21D 24/16 72/338

FOREIGN PATENT DOCUMENTS

EP 2 266 722 A1 12/2010
JP 1-293922 A 11/1989
(Continued)

OTHER PUBLICATIONS

JPO Machine Translation to English of JP 2007307616 A, Dec. 2018 (Year: 2018).*
(Continued)

*Primary Examiner* — Pradeep C Battula
(74) *Attorney, Agent, or Firm* — Birch, Stewart, Kolasch & Birch, LLP

(57) ABSTRACT

Tooling used in a punching process which uses a die and projecting punch to form a worked material of steel sheet into a predetermined outer shape, in which tooling for punching, a radius of curvature Rd of a die cutting edge is from 0.03 mm to 0.2 mm and an angle (α) formed by a tangent drawn from a punch cutting edge to a projection shoulder and a direction perpendicular to a direction of movement of the punch is from 12° to 72°, and a punching method and shaping method using the same, are provided. Further, when making the die cutting edge (shoulder R part) a two-stage R of radii of curvature R1 and R2 and making a slant of a line passing through the centers of R1 and R2 β, by making 0.03 mm≤R1≤0.2 mm, 1≤R2/R1≤5, 0≤R2(1−sin β1)≤0.3t, and 30°≤β≤90°, punching hole expandability can be improved.

4 Claims, 8 Drawing Sheets

(56) References Cited

FOREIGN PATENT DOCUMENTS

| | | | | | |
|---|---|---|---|---|---|
| JP | 5-138260 | A | | 6/1993 | |
| JP | 9-295072 | A | | 11/1997 | |
| JP | 2005-95980 | A | | 4/2005 | |
| JP | 2006-224151 | A | | 8/2006 | |
| JP | 2007-307616 | A | | 11/2007 | |
| JP | 2011-83793 | A | | 4/2011 | |
| WO | WO-2012146602 | A1 | * | 11/2012 | ..... B21D 24/16 |

OTHER PUBLICATIONS

International Search Report for PCT/JP2014/079887 dated Feb. 3, 2015.
Written Opinion of the International Searching Authority for PCT/JP2014/079887 (PCT/ISA/237) dated Feb. 3, 2015.

* cited by examiner (a)

(b)

(a)

(b)

TOOLING FOR PUNCHING STEEL SHEET AND PUNCHING METHOD

TECHNICAL FIELD

The present invention relates to tooling for punching thin-gauge steel sheet and a punching method using that tooling.

BACKGROUND ART

To deal with the need for lightening the weight of automobiles, which began back with the old oil crises, the steel sheet used for automobiles has been made higher in strength. In recent years, a need has arisen for improving the safety of automobiles in collisions. The need is rising for further increasing the strength of steel sheet for automobile use. As steel sheet rises in strength, generally its shapeability is sacrificed and cracks easily form at the time of press-forming. For this reason, in application of high strength steel sheet, in the press-forming step, it is necessary to work to prevent cracking. In particular, in press-forming steel sheet for automobile use, "punching hole expansion" for stretching the punched end face in the circumferential direction is often seen. It is important to prevent cracking due to such shaping.

FIGS. 1A and 1B show the state of deformation of a worked material in a punching process using a conventional flat-bottomed punch. In this punching process, a large compressive or tensile stress is applied to the hardened layer shown in FIG. 1B, so that part is remarkably hardened. Further, for this reason, the ductility of the end face after punching deteriorated and the punching hole expandability of the punched hole remarkably deteriorated. The deterioration of the ductility of the end face due to this hardened layer is particularly remarkable in high strength steel. Improvement of the punching hole expandability of high strength steel sheet now being made much use of to deal with the recent needs for lightening the weight of automobiles is being sought.

As an art for punching for improving this punching hole expandability, the art of punching using a punch with a projection attached to its tip has been proposed (PLTs 1 and 2).

The principle of improvement of the punching hole expandability by this art will be explained below. The punching hole expandability deteriorates in the punching process due to the formation of a work hardened layer at which the plastic strain accumulates. In the punching process, first, the punch and die shear the worked material whereby a shear plane is formed. Next, a crack occurs and advances in the worked material near the cutting edges of the punch and die resulting in a fracture surface. This crack grows and leads to fracture. The plastic strain on the worked hardened layer of the fracture surface mainly occurs at the stage of formation of the shear plane, so the shorter the stage of formation of the shear plane, the smaller the plastic strain on the work hardened layer of the fracture surface. Due to the effect of the projection attached to the punch, tensile stress is given to the punched worked material in the vicinity of the cutting edges of the punch and die, the advance of a crack is promoted, and as a result it is possible to shorten the stage of formation of the shear plane. Due to this effect, the strain at the punched end face is suppressed and the punching hole expandability is improved.

In PLT 1, furthermore, to prevent shearing of the material due to the projection, making the radius of curvature Rp of the shoulder of the projection 0.2 mm or more or making the projecting shoulder angle from 100° to 170° are made requirements. In PLT 2, to improve the ductility of the end face of the worked material, making the angle of the tangent drawn from the punch cutting edge to the projection 3° to 70° is made a requirement.

CITATION LIST

Patent Literature

PLT 1. Japanese Patent Publication No. 2005-95980A
PLT 2. Japanese Patent Publication No. 2007-307616A

SUMMARY OF INVENTION

Technical Problem

According to the prior art, it is possible to obtain a high strength steel sheet of a tensile strength of approximately 800 MPa where a 80% or more punching hole expansion ratio is obtained. Due to this art, a certain effect of lightening the weight of the automobile is obtained. However, this cannot be said to be necessarily sufficient for dealing with the further rising needs for high strength steel sheet of recent years. To sufficiently deal with such needs, realization of a 90% or more punching hole expansion ratio is being sought in high strength steel sheet with a tensile strength of about 800 MPa. The present invention has as its object realization of punching tooling and a working method realizing a punching hole expansion ratio of 90% or more in punching 800 MPa class high strength steel sheet.

Solution to Problem

The inventors engaged in intensive studies to solve the above problems in punching by a projecting punch and obtained the following findings.

(a) Optimization of Shape of Cutting Edge of Die

At the time of punching, the way force acts differs at the punch side and die side of the worked material of the high strength steel sheet, so there inherently should be optimal shapes of the cutting edge shape of the punch and the cutting edge shape of the die. The prior art mainly studies the cutting edge of the punch. The cutting edge shape of the die is not the optimal one. Therefore, the inventors engaged in detailed studies focusing on the shape of the cutting edge of the die. First, if the shoulder R of the die (corresponding to shape of cutting edge at radius of curvature of die) is small, the die side of the worked material of the steel sheet receives extreme compressive stress. For this reason, the compressive stress region in a cross-section of the steel sheet becomes broader. The part which receives compressive stress is inhibited in crack propagation, so fractures by shear fracture. Due to this, the shear plane increases and the work hardened layer becomes greater. On the other hand, if the shoulder R of the die is too large, the tensile stress acts at the die side of the steel sheet as well, so crack propagation proceeds and shear fracture becomes limited. For this reason, the work hardened layer is also reduced, so ductility can be secured. However, the shoulder R is large, so there is a possibility of deformation of the steel sheet after cutting (sagging in the downward direction of the punch). Considering these facts, the inventors discovered that in 800 MPa or more high strength steel sheet, it is suitable to make the shoulder R of the die from 0.03 mm to 0.2 mm.

(b) Two-Stage R Design of Die Shoulder

Furthermore, the inventors discovered that by making the die shoulder (cutting edge part) a shape having two radii of curvature (below, called "two-stage R"), it is possible to suppress the compressive stress while cutting. If the die shoulder is a shape having one radius of curvature (below, sometimes called "one-stage R"), due to bending of the steel sheet at the die shoulder, a region where compressive stress acts is formed at the die side of the steel sheet. Due to the compressive stress due to this bending, the tensile stress which is created at the steel sheet due to the projecting punch is eased. The crack propagating ability becomes worse by that amount. Therefore, by making the die shoulder R two stages, the bending of the steel sheet at the die shoulder can be partially eased, the region where the compressive stress due to this bending acts can be reduced, and crack propagating ability can be improved. Further, in the case of punching tooling, the clearance of the punch and die is also important. When making the die shoulder a two-stage shoulder R, if making the radius of curvature R1 of the arc part at the punch side larger, as a result, the clearance becomes greater and the sharpness becomes duller. For this reason, the inventors discovered that when making the die shoulder a two-stage shoulder R, it is sufficient to make the radius of curvature R1 of the punch side smaller than the radius of curvature R2 of the reverse side to the punch (sheet holder side). Furthermore, when a steel sheet is cut, the radius of curvature R1 of the punch side is effective, so this radius of curvature R1 should be made the above-mentioned optimum range. Due to this, it is possible to decrease the compressive stress acting on the steel sheet. Crack propagation due to higher tensile stress can be obtained. Further, it is possible to reduce the shear plane due to shear fracture, possible to reduce the work hardened layer, and possible to improve the hole expandability. However, it is necessary to keep the deformation in the elastic range of the steel sheet, so it is necessary to restrict the amount of sink of the steel sheet at the die shoulder.

(c) Optimization of Projecting Punch Shape

On the other hand, the shape of a projecting punch able to efficiently cause tensile stress at a worked material of steel sheet at the time of cutting has also been studied in detail. As a result, the inventors discovered that there is an optimal range to the angle ($\alpha$) formed by the tangent drawn from the shoulder forming the punch cutting edge (punch cutting edge end) to the projection shoulder and the line perpendicular to the direction of movement of the punch. That is, it is learned that when a is from 12° to 72°, a large tensile stress is generated and the crack propagating ability is increased.

The present invention was made based on these discoveries and has as its gist the following:

(1) Tooling for punching a steel sheet comprised of at least a die, a sheet holder, and a projecting punch, in which tooling for punching a steel sheet, in a cross-section parallel to a direction of movement of the punch of the punching tool and vertical to a ridgeline formed by a cutting edge of the punch or die, the radius of curvature R of a shoulder forming the cutting edge of the die is from 0.03 mm to 0.2 mm and an angle $\alpha$ formed by a line drawn from the shoulder forming the cutting edge of the punch to the shoulder of the projection and a direction perpendicular to the direction of movement of the punch is from 12° to 72°.

(2) The tooling for punching a steel sheet according to (1), wherein the curvature of the shoulder forming the cutting edge of the die is comprised of two radii of curvature, the radius of curvature of the curve facing the punch being R1, and the radius of curvature of the other curve being R2, and when the angle formed by the line passing through the intersection of the two curves based on R1 and R2 and the center of curvature of R1 with the direction perpendicular to the direction of movement of the punch is $\beta$ and the thickness of the steel sheet is "t", $0.03\ \text{mm} \le R1 \le 0.2\ \text{mm}$ $1 \le R2/R1$ $30° \le \beta \le 90°$ where, the units of R1, R2, and "t" are all mm.

(3) The tooling for punching a steel sheet according to (2), wherein further said two radii of curvature R1 and R2 satisfy $1 \le R2/R1 \le 7$ and $R2(1-\sin\beta) \le 3t$ (4) A method of punching a steel sheet using tooling for punching comprised of at least a die, a sheet holder, and a projecting punch, in which method of punching a steel sheet, in a cross-section parallel to a direction of movement of the punch of the punching tool and vertical to a ridgeline formed by a cutting edge of the punch or die, the radius of curvature R of a shoulder forming the cutting edge of the die is from 0.03 mm to 0.2 mm and an angle $\alpha$ formed by a line drawn from the shoulder forming the cutting edge of the punch to the shoulder of the projection and a direction perpendicular to the direction of movement of the punch is from 12° to 72°.

(5) The method of punching a steel sheet according to (4), wherein the curvature of the shoulder forming the cutting edge of the die is comprised of two radii of curvature, the radius of curvature of the curve facing the punch being R1, and the radius of curvature of the other curve being R2, and when the angle formed by the line passing through the intersection of the two curves based on R1 and R2 and the center of curvature of R1 with the direction perpendicular to the direction of movement of the punch is $\beta$ and the thickness of the steel sheet is "t", $0.03\ \text{mm} \le R1 \le 0.2\ \text{mm}$ $0.03\ \text{mm} \le R1 \le 0.2\ \text{mm}$ $1 \le R2/R1$ $30° \le \beta \le 90°$ where, the units of R1, R2, and "t" are all mm.

(6) The method of punching a steel sheet according to (5) wherein further said two radii of curvature R1 and R2 satisfy $1 \le R2/R1 \le 7$ and $R2(1-\sin\beta) \le 3t$

Advantageous Effects of Invention

According to the present invention, it is possible to improve the punching hole expandability of 800 MPa or more high strength steel sheet and possible to achieve a hole expansion ratio of 90% in punched steel sheet. For this reason, application of high strength steel sheet to auto parts becomes possible. Due to this, lightening the automobile chassis becomes easier and it becomes possible to contribute to the reduction of the fuel consumption of automobiles and improvement of safety in collisions.

BRIEF DESCRIPTION OF DRAWINGS

FIG. 1A is a view showing a relationship of a punch, die, and worked material. FIG. 1B is a view showing a deformation behavior of a worked material.

FIG. 7A is a view showing a cross-section of punching tooling using a conventional flat-bottomed punch, while FIG. 7B is a view showing a cross-section of punching tooling using a projecting punch according to the present invention.

DESCRIPTION OF EMBODIMENTS

Figure 1:
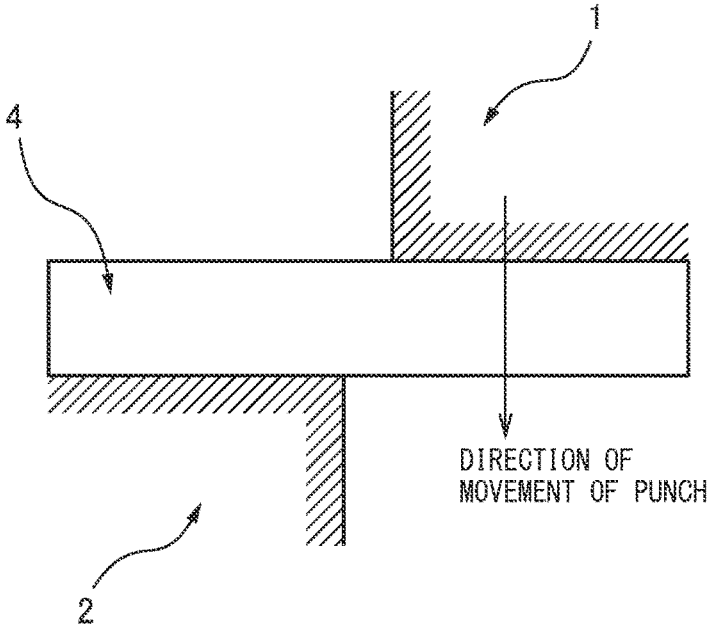
FIGS. 1A and 1B are views showing a conventional flat-bottomed punch.
Figure 1:
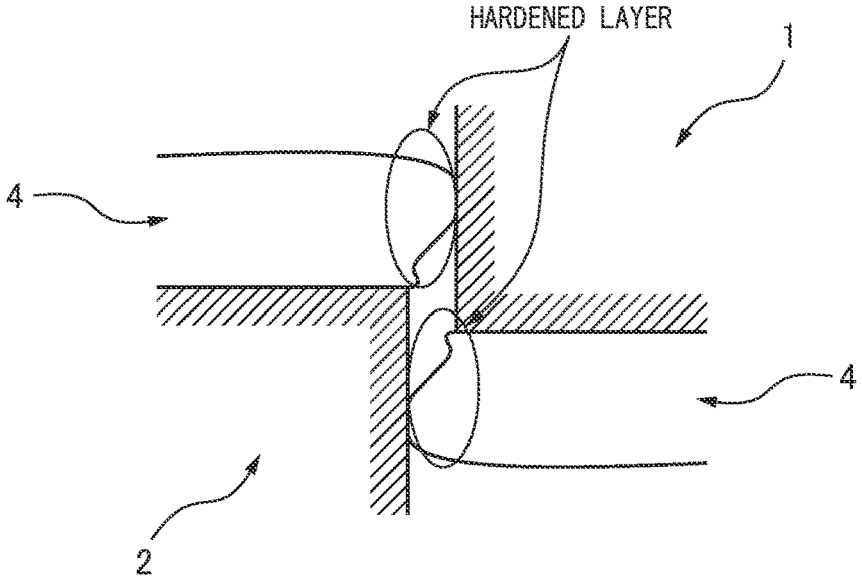
Figure 2:
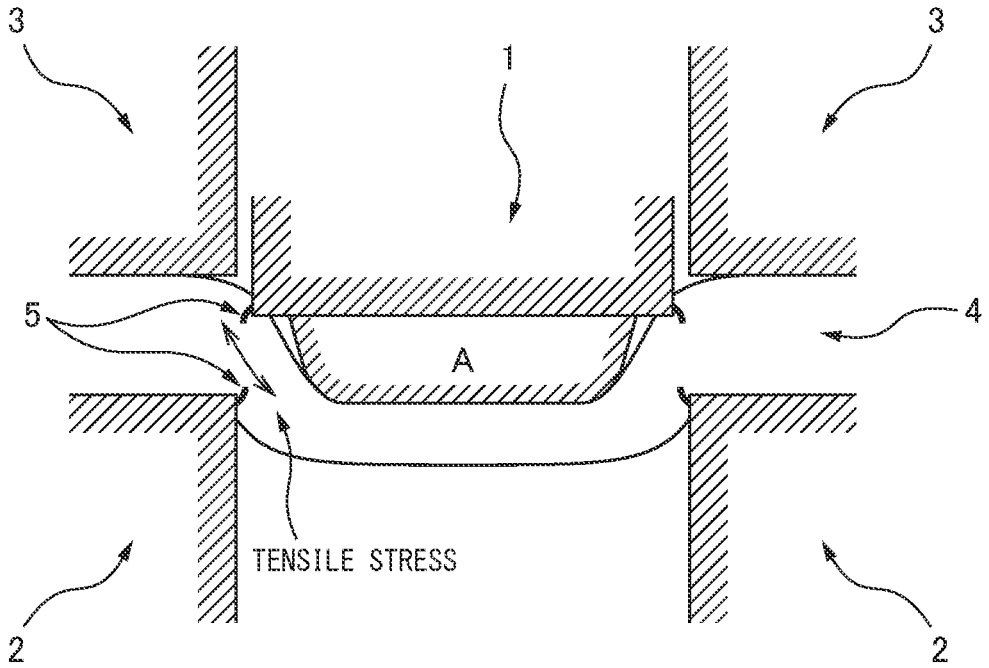
FIG. 2 is a view showing a deformation behavior of a worked material during punching by a conventional projecting punch.
Figure 3:
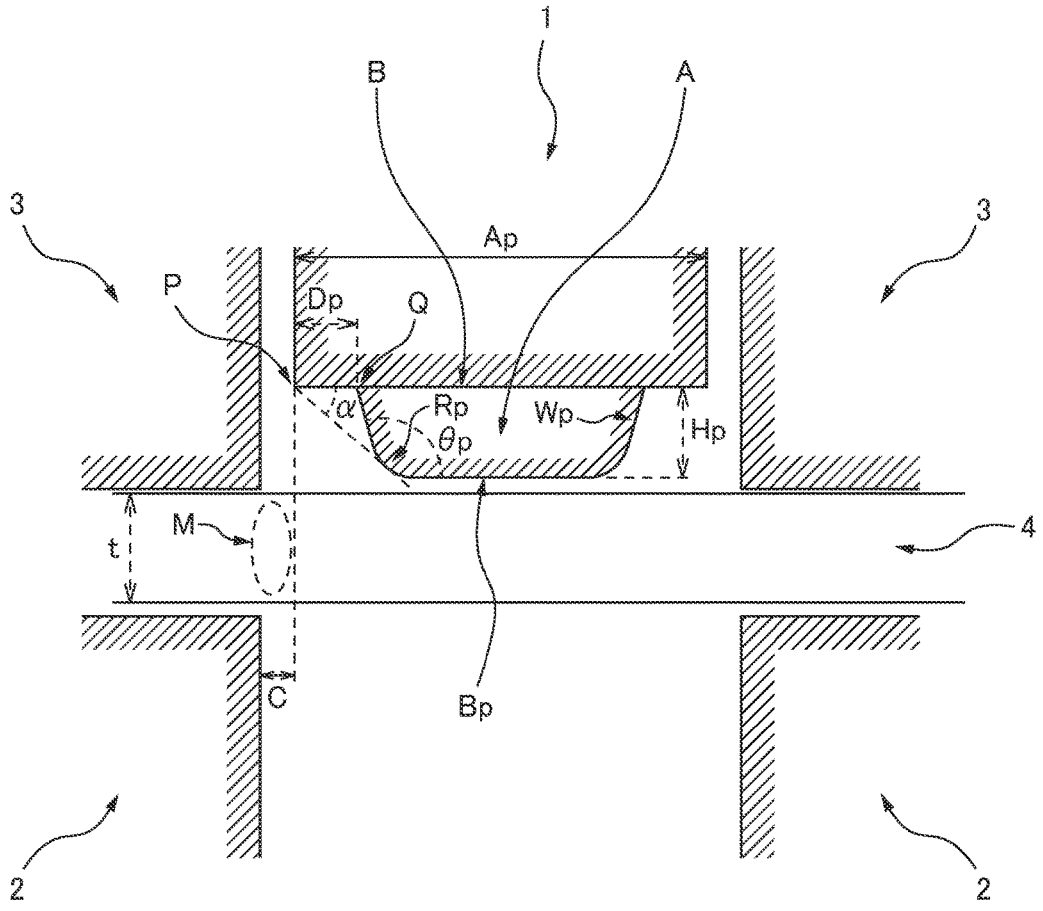
FIG. 3 is a view showing the cross-section of punching tooling using a conventional projecting punch.
Figure 4:
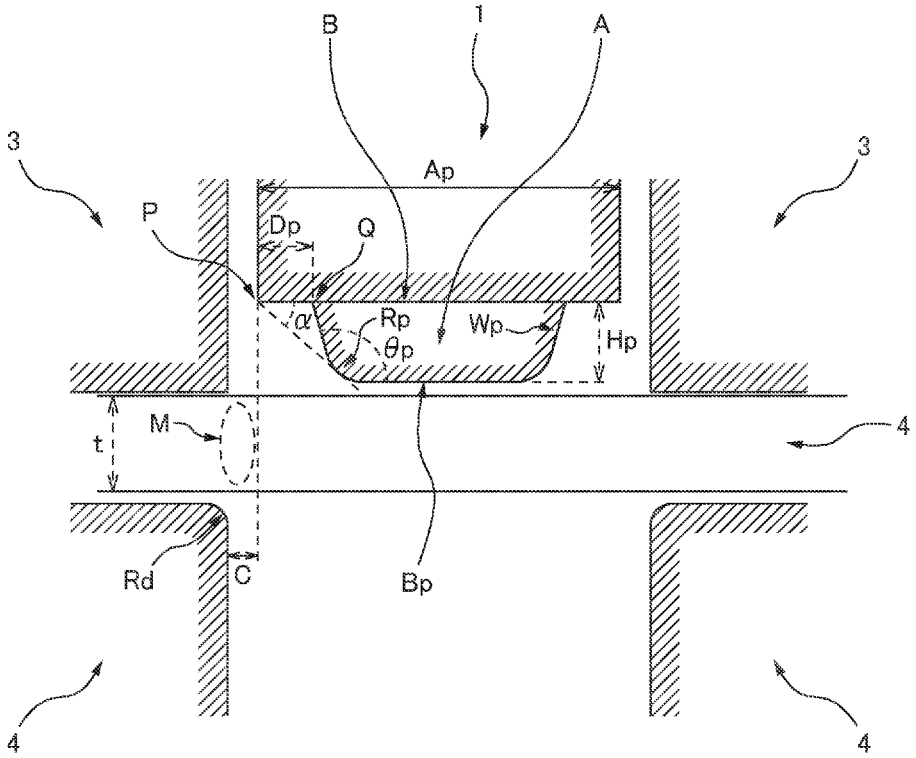
FIG. 4 is a view showing the cross-section of punching tooling using a projecting punch according to the present invention.

The present invention will be explained using the drawings. Note that, the "shape" referred to in the present application, unless otherwise indicated, refers to a shape which can be observed in the cross-section parallel to the direction of movement of the punch of the punching tooling and vertical to the ridgeline formed by the cutting edge of the punch or die. Further, unless otherwise indicated, the units used for the radius of curvature, sheet thickness, etc. are mm. FIG. 3 is a cross-sectional view of a conventional projecting punch, while FIG. 4 is a cross-sectional view of punching tooling according to the present invention provided with a predetermined radius of curvature Rd at the die shoulder.

First, when the effect of improvement of the punching hole expandability when using a projecting punch for punching will be explained.

As disclosed in PLTs 1 and 2, when making the punch shape a structure comprised of the cutting edge B and projection A such as shown in FIG. 3 and giving the part cut by the cutting edge B (cut part M of worked material) tensile stress by the projection A, formation and progression of a crack in the vicinity of the cutting edge B are promoted by the tensile stress and the worked material is cut by the cutting edge B without large plastic deformation, so the strain at the punching end face is reduced and the punching hole expandability is improved.

At this time, if the projection shape is not made a predetermined shape, a sufficient effect of improvement of the punching hole expandability cannot be obtained. That is, to give sufficient tensile stress due to bending at the part M sheared by the cutting edge B, it is necessary to prevent the phenomenon of shearing of the worked material by the projection A. However, for this reason, the shoulder of the projection A has to be given a predetermined radius of curvature Rp or has to be given a predetermined angle θp. Further, in the present invention, to prevent shearing due to the projection, the radius of curvature Rp of the shoulder of the projection has to be made 0.2 mm or more or the projecting shoulder angle θp has to be made from 100° to 170°.

Further, in the present invention, the angle (α) formed by the tangent drawn from the shoulder forming the punch cutting edge (punch cutting edge end) to the shoulder of the projection and the direction perpendicular to the direction of movement of the punch should be made from 12° to 72°. If this angle α is smaller than 12°, the effect of giving tensile stress to the worked material in the material in the vicinity of the punch shoulder or the die shoulder cannot be sufficiently obtained and the effect of reduction of strain due to the projection cannot be obtained. The angle should preferably be 20° or more, more preferably 30° or more. Further, if the angle α is larger than 72°, an excessive strain due to the projection is given to the end face and the punching hole expandability deteriorates. The angle should preferably be 60° or more, more preferably 50° or less.

The present invention tries to further improve the punching hole expandability by giving a predetermined radius of curvature Rd to the die shoulder (cutting edge) based on the above art as shown in FIG. 4. This is thought to be due to the fact that by the die shoulder (cutting edge) being given the radius of curvature Rd, during shearing, the plastic strain occurring at the die shoulder (cutting edge) is dispersed and the plastic strain at the punching end face is reduced. Due to this, the punching hole expandability is improved. This effect is obtained when using a projecting punch. A similar effect cannot be obtained in the case of a normal flat-bottomed punch.

Figure 5:
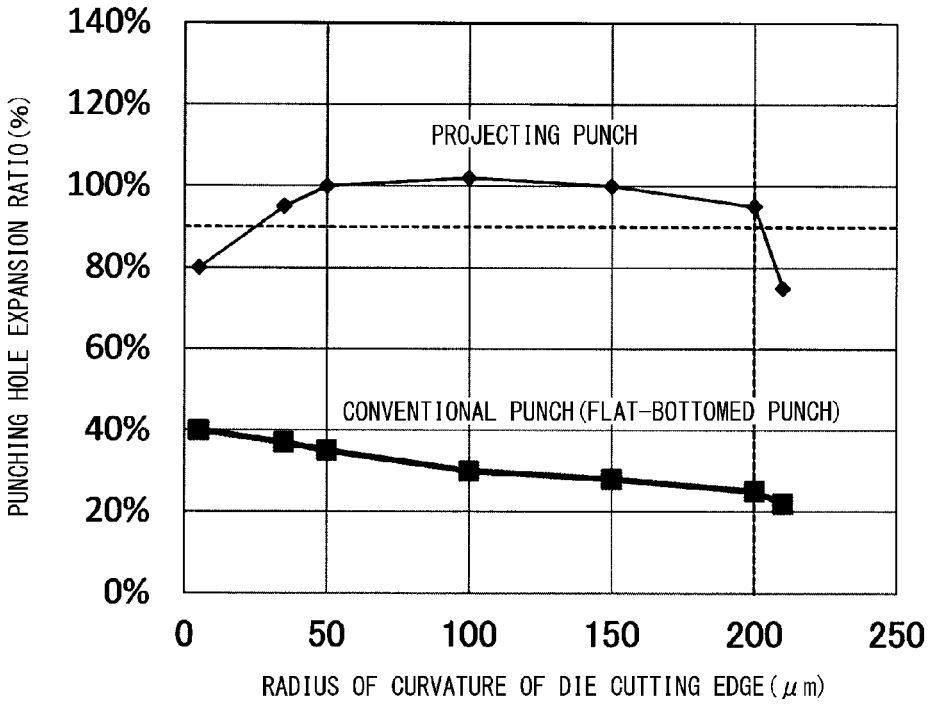
FIG. 5 is a view showing the relationship between the radius of curvature Rd of the die shoulder and the punching hole expansion ratio.

FIG. 5 shows the change of the punching hole expansion ratio when changing the radius of curvature Rd of the die shoulder when using the projecting punch of FIG. 4. For comparison, the case of using an ordinary flat-bottomed punch is also shown. The punch diameter at this time is 10 mm, while the die inside diameter is 10.65 mm. Further, the worked material used for the test is a high strength hot rolled steel sheet having a 820 MPa tensile strength, 591 MPa yield strength, and 32% total elongation and having a sheet thickness of 2.6 mm. The punching clearance was made 12.5%. Regarding the shape of the projecting punch, the distance Dp of the cutting edge end P and the projection rising position D was made 1.0 mm, the punch projecting shoulder angle θp was made 135°, the radius of curvature Rp of the punch projecting shoulder was made 0.5 mm, and the punch projecting height Hp was made 3.0 mm.

The radius of curvature Rd of the die shoulder changes between about 0 to 0.025 mm (25 μm) in normal operation in the punching process. That is, in new die, the radius of curvature Rd of the shoulder is about 0 mm. As the number of punching operations increases, the radius of curvature Rd of the die shoulder increases due to the wear. Further, if wear progresses, the die is replaced. With the usual period of replacement, the radius of curvature Rd of the shoulder becomes larger to about 0.025 mm or so.

Further, the punching hole expansion ratio is found by inserting an apex angle 60° conical punch into an initial hole, pushing it to expand the hole, stopping the punch when a crack passes through the hole end face in the direction of sheet thickness, and finding the rate of increase with respect to the initial diameter (for example 10 mm) of the hole diameter at that time. Further, the punching clearance is defined as the punch and die clearance C/sheet thickness t×100(%).

In FIG. 5, by using the projecting punch, the punching hole expandability is remarkably improved compared with the case of a flat-bottomed punch. Further, when using a projecting punch, if the radius of curvature Rd of the die shoulder (cutting edge) is too small, the punching hole expansion ratio is low. This reason is considered as follows. If the radius of curvature Rd of the die shoulder is small, strain concentrates at the worked material near the die shoulder and remains on the punching end face. On the other hand, even if the die shoulder radius of curvature Rd is too large, punching hole expandability deteriorates. This is because if the die shoulder radius of curvature Rd is large, the occurrence of a crack from the die shoulder (cutting edge) is delayed and therefore the strain applied to the end face up to the occurrence of a crack increases.

The requirement will be explained below based on FIG. 4. The punch or die of the present invention has to be made a two-stage structure of the projection A and cutting edge part B. This is because before using the cutting edge B to shear the worked material, the projection A is used to give tensile stress to the cutting part M of the worked material and the strain at the cutting end face of the worked material after cutting is reduced.

The radius of curvature Rp of the punch projecting shoulder may be made 0.2 mm or more. This is because if the radius of curvature Rp of the projecting shoulder is 0.2 mm or less, the worked material is sheared by the projection A and sufficient tensile stress cannot be given to the part M sheared by the cutting edge B. In the present invention, the radius of curvature Rp of the projecting shoulder does not particularly have an upper limit, but depending on the size of the punch, if the radius of curvature Rp becomes too large, it becomes difficult to enlarge the projecting height Hp, so 5 mm or less is preferable.

Further, the angle θp of the projecting shoulder may be made from 100° to 170°. This is because if the angle θp of the projecting shoulder is 100° or less, the projection A causes the worked material to be sheared, so sufficient tensile stress cannot be given to the part M sheared by the cutting edge B. Further, if the angle θp of the projecting shoulder is 170° or more, the part sheared by the cutting edge B cannot be given sufficient tensile stress. However, the provision relating to the radius of curvature Rp of the projecting shoulder and the angle θp of the projecting shoulder is a provision for preventing the projection from shearing the material. For this reason, it is sufficient that either of these be satisfied.

In punching according to the present invention, the effect of the punching clearance with respect to the end face ductility (clearance C/sheet thickness t×100(%) in FIG. 4) is the same as the prior art. Compared with the conventional punching method, it is not necessary to pay special attention to it.

The Rd of the die shoulder (cutting edge) (radius of curvature Rd of die cutting edge) should be from 0.03 mm to 0.2 mm. If the die shoulder Rd is too small, a large strain concentrates at the part of the steel sheet contacting the die shoulder (cutting edge) (below, referred to as the "steel sheet in the vicinity of the die shoulder"), the punching hole expandability deteriorates. On the other hand, if the die shoulder Rd is too large, the formation of cracks from the steel sheet in the vicinity of the die shoulder (cutting edge) is delayed and strain concentrates at the end face. For this reason, upper and lower limits of the above-mentioned die shoulder (cutting edge) Rd are provided from the viewpoint of minimizing the strain of the end face and improving the punching hole expandability. To particularly improve the punching hole expandability, the radius of curvature Rd of the die shoulder is preferably form 0.05 mm to 0.15 mm.

In normal punching, normally a sheet holder (wrinkle preventer) can be suitably used to fasten the worked material to the die. In the punching method of the present invention as well, a sheet holder is preferably used. The sheet holder load (load applied from sheet holder to worked material) does not particularly affect the punching hole expandability, so is not limited.

The punch speed is also not limited since it does not have a large effect on the punching hole expandability if in the normal range of punching of steel sheet. In most cases, to suppress wear of the tooling in the punching process, the tooling or worked material is coated with lubrication oil. In the present invention as well, a suitable lubricating oil may also be used.

Further, to give a sufficient tensile stress by the projection A, the projecting height Hp is preferably made 10% or more of the sheet thickness of the worked material.

Further, the clearance Dp of the cutting edge end P and the rising position Q of the projection is preferably made 0.1 mm or more. This is because if this clearance is 0.1 mm or less, when using the cutting edge B to shear the worked material, a crack usually occurring from the vicinity of the tip of the cutting edge becomes harder to occur and strain is applied to the cutting position by the cutting edge.

Further, in the punch according to the present invention, the portion between the cutting edge end P and the rising position Q of the projection, the bottom surface part Bp of the projection, and the vertical wall part of the projection A are preferably flat shapes in fabrication of the punch, but even there are some relief shapes, the effect is the same so long as the above-mentioned requirements are satisfied.

The present invention improves the punching hole expandability by attaching the projection A to the flat-bottomed punch comprised of only the conventional cutting edge B. By attaching the projection A and increasing the projecting height Hp, the planar pressure of contact of the cutting edge B and the worked material falls, so the amount of wear of the cutting edge end P is also reduced. From this viewpoint, the higher the projecting height Hp, the more preferable. However, if too high, depending on the worked material concerned, the worked material fractures between the projection A and cutting edge B before the cutting edge B and the worked material contact, and the effect will not be obtained. For this reason, in such a case, the projecting height Hp is preferably made generally 10 mm or less.

The angle (α) formed by the tangent drawn from the shoulder forming the punch cutting edge (punch cutting edge end) to the projection shoulder and the direction perpendicular to the direction of movement of the punch should be from 12° to 72°. If this angle α is too much smaller than 12°, the effect of giving tensile stress to the worked material in the vicinity of the cutting edge of the punch at the material is not sufficiently obtained, while the effect of reduction of the strain due to the projection cannot be obtained. Preferably, it may be made 20° or more, more preferably 30° or more. Further, if the angle α is the overly large 72°, excessive strain due to the projection is given to the end face and the punching hole expandability deteriorates. It is preferably made 60°, more preferably made 50° or more.

In the present invention, making the speed of movement of the punch at the time of hole expansion after punching larger and making the strain rate in the circumferential direction of the end face larger are preferable in obtaining a large punching hole expandability. This is because the larger the strain rate in the circumferential direction of the end face, at the point of time of the same punch stroke, the amount of advance of a crack is small and the progression of a crack on the punched end end face at the time of hole expansion becomes slower. From this viewpoint, the strain rate of the end face is preferably made 0.1/sec or more. On the other hand, from this viewpoint, it is preferable to make the speed of movement of the punch larger, but when the speed of movement of the punch is excessively large, control of the mechanical system for this becomes difficult, so the upper limit of the strain rate is made 5.0/sec.

Figure 6:
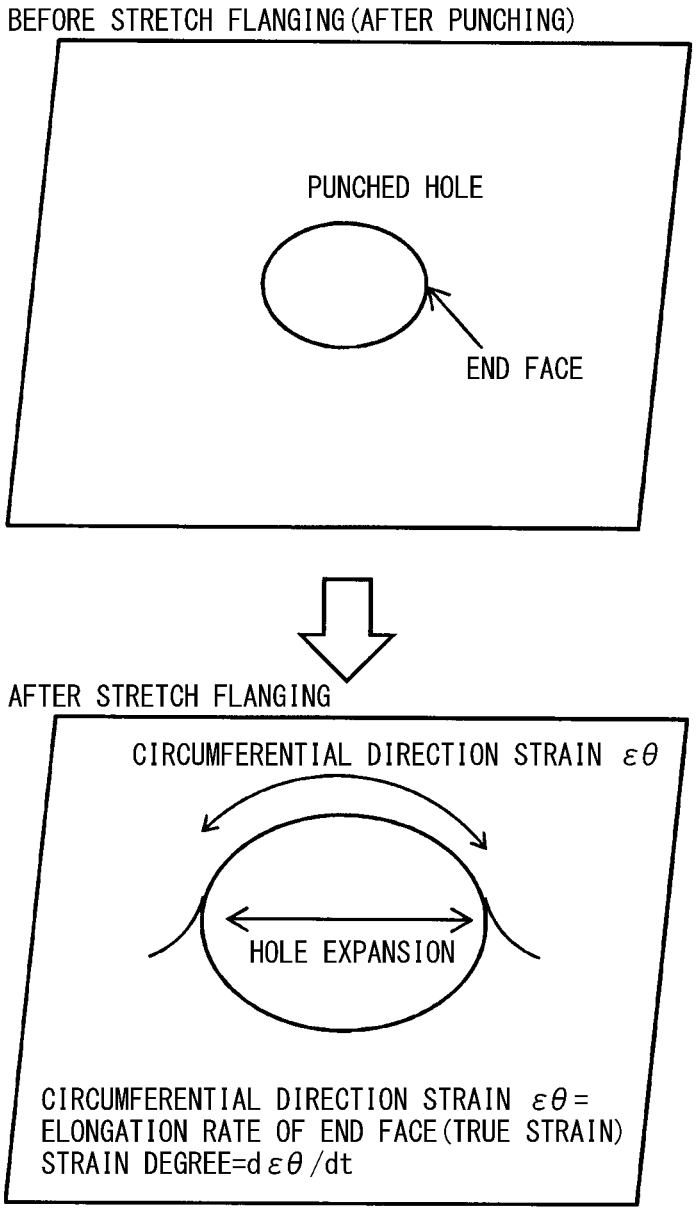
FIG. 6 is a reference view showing a hole expansion ability (stretch flangeability).

Here, the "strain rate" in the circumferential direction of the end face indicates the rate of increase ($d\varepsilon\theta/dt$) of the circumferential direction strain ($\varepsilon\theta$) of the end face when stretching the end face caused by punching in the circumferential direction by the later press-forming step such as shown in FIG. 6.

Figure 8:
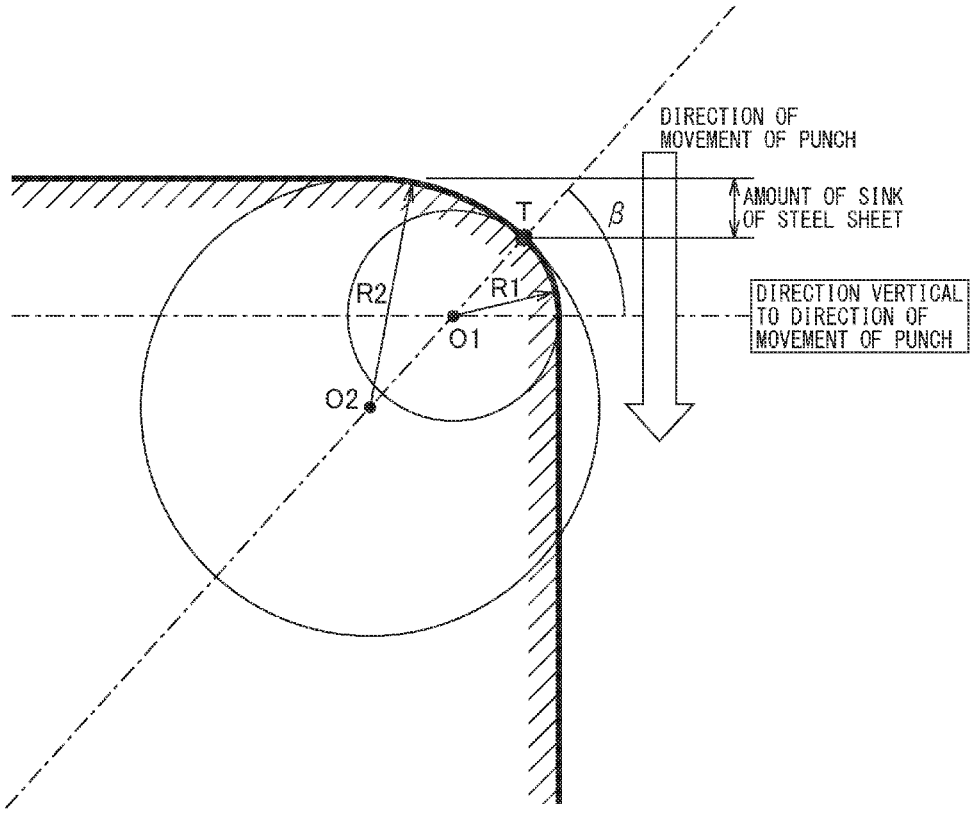
FIG. 8 is a view showing a die shoulder having a two-stage shoulder R.

Next, the two-stage shoulder R will be explained. FIG. 8 is a cross-sectional view of the shoulder of the die having the two-stage shoulder R. As explained above, this cross-section is the cross-section parallel to the direction of movement of the punch of the punching tooling and vertical to the ridgeline formed by cutting edge of the punch or die. Among the two radii of curvature at the two-stage shoulder R, as explained above, the radius of curvature R1 of the punch side should be smaller than the radius of curvature R2 of the opposite side (sheet holder side) of the punch. Due to this, it is possible to maintain the clearance between the punch and die while easing the compressive stress occurring at the die side of the worked material of the steel sheet.

The arcs due to the two radii of curvature have to be smoothly connected, so the circles of the two radii of curvature contact each other. That is, the inflection point of the die shoulder R becomes the intersection (contact point) T of the arcs of the two radii of curvature. At this time, the contact points of the centers of curvature O1 and O2 of R1 and R2 (centers of arcs) and the two arcs are on the same line. The angle of the line passing through the centers of curvature of R1 and R2 and the direction perpendicular to the direction of movement of the punch is made β. If the two radii of curvature R1 and R2 and the angle β are determined, the shape of the cutting edge of the die can be determined. The relationship between R1 and R2 and the angle β will be explained below.

In the case of punching tooling, the clearance of the punch and die is important. When making the die shoulder the two-stage shoulder R, if increasing the radius of curvature R1 of the arc part at the punch side, as a result, the clearance increases and the sharpness becomes duller. For this reason, the inventors discovered that when making the die shoulder the two-stage shoulder R, the radius of curvature R1 of the punch side should be made smaller than the radius of curvature R2 of the reverse side to the punch (sheet holder side). Furthermore, when a steel sheet is cut, the radius of curvature R1 at the punch side becomes effective, so this radius of curvature R1 should be made the optimal range of the radius of curvature Rd in the case of the above-mentioned single-stage shoulder R.

Further, from the viewpoint of securing the cuttability (sharpness), the arc of the radius of curvature R1 should account for one-third (⅓) or more of the shoulder as a whole. That is, β is preferably made 30° or more. If smaller than this, the arc of R2 of the larger radius of curvature becomes dominant and the cuttability deteriorates. Preferably, β where the arc of R1 becomes half or more should be 45° or more. The upper limit of β is not particularly limited. Geometrically, 90° becomes the upper limit. Due to the above, the radii of curvature R1 and R2 and β should be made $0.03\ \text{mm} \leq R1 \leq 0.2\ \text{mm}$ $1 \leq R2/R1$ $30° \leq \beta \leq 90°$ The upper limit of the radius of curvature R2 of the opposite side (sheet holding side) from the punch of the die shoulder R is not particularly limited. However, if the amount of sink (amount of deflection) of the steel sheet at the time of cutting is too large, the steel sheet ends up plastically deforming. After cutting as well, this deformation is feared to remain. From this viewpoint, it is possible to define the upper limit of the radius of curvature R2. Here, the amount of sink of the steel sheet, as shown in FIG. 8, is shown by the distance R2(1−sin β) in the direction of movement of the punch from the die surface to the contact point T of the two radii of curvature. It was confirmed that if the amount of sink of the steel sheet is made 3 times the sheet thickness "t" or less, cutting is possible without particular deformation. That is, this should be made $R2(1-\sin\beta) \leq 3t$ (where, $30° \leq \beta \leq 90°$)

Further, the upper limit of R2 can be defined not only by the provision on the amount of sinking of the steel sheet, but also from the viewpoint of the practical manufacturability. From the viewpoint of the manufacturability, R2 should be made 7 times R1 or less. R2 has to be at least R1 or more, so R2 and R1 should satisfy the following relationship. That is, they may be made $1 \leq R2/R1 \leq 7$.

R1, R2, and β can be made any values so long in the range satisfying these relationships. Punching tooling sufficiently satisfying the effect of the present invention can be obtained. Here, the above-mentioned die of the single-stage shoulder R is one where R1=R2. At this time, β may be considered to be 45°. Above, the present invention was explained in detail, but embodiments of the present invention are not limited to the ones describe here.

EXAMPLES

Example 1

Figure 7:
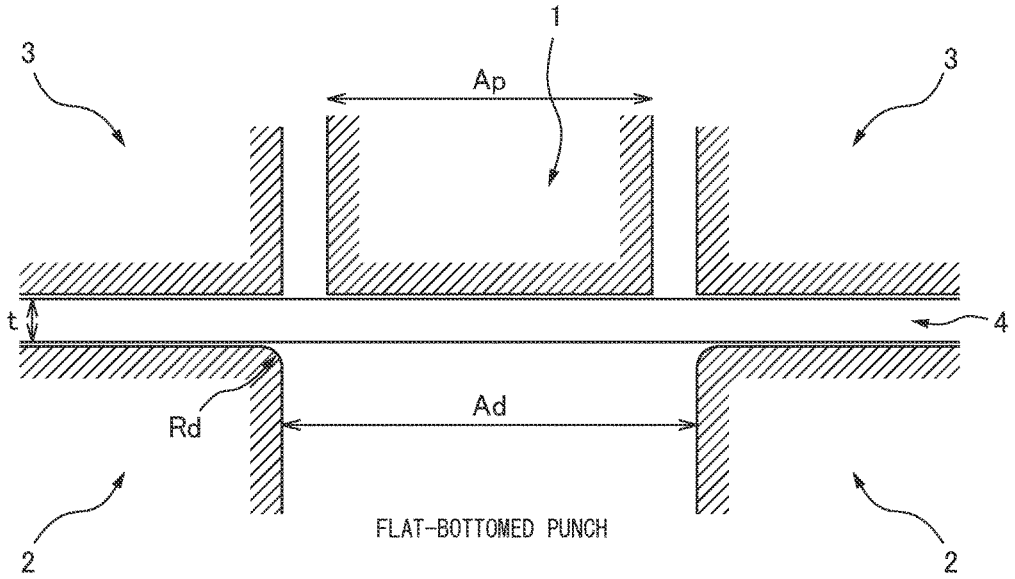
Figure 7:
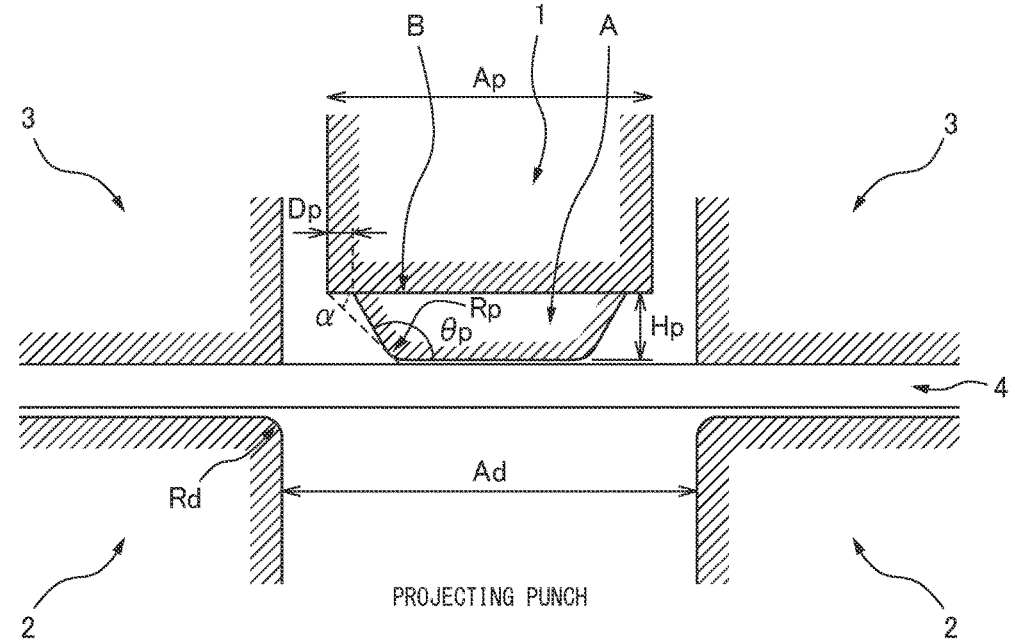

Below, examples of the present invention will be explained. The flat-bottomed punch (FIG. 7(*a*)) and projecting punch (FIG. 7(*b*)) shown in FIG. 7 were used for punching, then a hole expansion test was performed. The mechanical properties of the test steel were TS=820 MPa, YP=591 MPa, and T.El=32%. The sheet thickness of the test steel was made from 1.2 to 5.0 mm by grinding. The size of the test piece used was made a width of 150 mm and a length of 150 mm.

The hole expansion test was conducted by using an apex angle 60° conical punch and using "outside burr" conditions, that is, setting the test piece so that the surface of the steel sheet contacting the die at the time of removal becomes the opposite side of the punch at the time of the hole expansion test. The punch was pushed into the punching hole, the punch was moved until the crack penetrated to the punching end face, the hole diameter D at that point of time was measured, and the following equation was used to find the punching hole expansion ratio.

$$\text{Punching hole expansion ratio (\%)} = (D(\text{mm}) - D0\ (\text{mm}))/D0\ (\text{mm}) \times 100(\%)$$

Here, the initial hole diameter D0 was made from 10 to 50 mm (value of "punch diameter Ap" described in Table 1). The punching clearance was made from 5 to 20% of the sheet thickness. Table 1 describes the test conditions and the punch shape and die shape used for the test. The clearance (%) in Table 3 is a value defined by the clearance C/sheet thickness t×100(%) of the punch and die.

The punching hole expansion ratios obtained by the test are also shown in Table 1. For both the punching hole expansion tests, five test pieces were used for the tests. The punching hole expansion ratios are expressed by the average values.

Level (1) is a test using a flat-bottomed punch for conventional punching. It forms the reference for comparison of the punching hole expansion ratios by the punching according to the present invention. In this case, a 40% punching hole expansion ratio can be obtained. The punching hole expansion ratio necessary for obtaining the effect of lightening the weight of auto parts aimed at by the present invention is 90% or more.

In Levels (3), (7) to (11), (15), (17), (18), (22), (25) to (31), (36), (38), (43), and (47) to (48), the punch and die shapes satisfy all conditions. Good punching hole expansion ratios are obtained. Levels (7) to (11) are levels where the radius of curvature Rd of the die shoulder is changed. When Rd is from 0.03 mm to 0.2 mm, good punching hole expansion ratios are obtained. In particular, when Rd is from 0.05 mm to 0.15 mm, the punching hole expansion ratios become further better.

Levels (47) and (48) have larger punch speeds at the time of hole expansion compared with Level (7). Due to the increase in the strain rate in the circumferential direction of the end faces, larger punching hole expandabilities can be obtained.

Levels (2), (6), (13), (14), (16), (19), (20), (21), (23) to (24), (32) to (35), (37), (39) to (42), and (44) to (46) have small radii of curvature Rd of the die shoulder. For this reason, good punching hole expansion ratios are not obtained.

Level (4) has a larger angle α than predetermined. For this reason, the predetermined punching hole expansion ratio is not obtained.

Level (5) has a smaller angle α than predetermined. For this reason, the predetermined punching hole expansion ratio is not obtained.

Level (12) has an excessively large radius of curvature Rd of the die shoulder. Due to this, a good punching hole expansion ratio is not obtained.

Level (49) has a large circumferential direction strain of the end face at the time of hole expansion, but the punch speed also was large, so it was not possible to stop the punch at the point of time when a crack passed through the punching end face and not possible to find the punching hole expansion ratio.

Example 2

Next, a test was conducted while making the shoulder R of the die shown in FIG. 7B (R of cutting edge part) a two-stage shoulder R. Table 2 shows the test conditions and the shapes of the punch and die. Based on Level (8) of Example 1, R1 was made 0.05 mm (50 μm) and R2 was made 0.2 mm (200 μm). The test was conducted while making β 30°, 45°, and 75°. The test steel and the outline of the hole expansion tests etc. were the same in Example 1. The test conditions, the punch shapes and die shapes used for the tests, and the punching hole expansion ratios are shown in Table 2. As a result, it is learned that compared with Level (8) of Example 1, the punching hole expandability can be improved.

TABLE 1

| Level | | Test conditions | | | Punch shape | | | | | |
|---|---|---|---|---|---|---|---|---|---|---|
| | Sheet thickness (mm) | Die Type | Punching speed (mm/sec) | Sheet holding load (tonf) | Punch dia. Ap (mm) | Projection height Hp (mm) | Distance between projection and cutting edge Dp (mm) | Projection shoulder angle (°) | Projection radius of curvatuve Rp (mm) | Angle α (°) |
| 1 | 2.6 | Flat-bottomed punch | 1 | 0.5 | 10 | — | — | — | — | |
| 2 | 2.6 | Projecting punch | 1 | 0.5 | 10 | 3 | 1.0 | 90 | 0.5 | 36.9 |
| 3 | 2.6 | Projecting punch | 1 | 0.5 | 10 | 3 | 1.0 | 90 | 0.5 | 36.9 |
| 4 | 2.6 | Projecting punch | 1 | 0.5 | 10 | 3 | 0.4 | 90 | 0.5 | 18.4 |
| 5 | 2.6 | Projecting punch | 1 | 0.5 | 10 | 0.5 | 3.0 | 90 | 0.5 | 39.8 |
| 6 | 2.6 | Projecting punch | 1 | 0.5 | 10 | 5 | 1.0 | 135 | 0 | 39.8 |
| 7 | 2.6 | Projecting punch | 1 | 3 | 10 | 5 | 1.0 | 135 | 0.5 | 39.8 |
| 8 | 2.6 | Projecting punch | 1 | 3 | 10 | 5 | 1.0 | 135 | 0.5 | 39.8 |
| 9 | 2.6 | Projecting punch | 1 | 3 | 10 | 5 | 1.0 | 135 | 0.5 | 18.4 |
| 10 | 2.6 | Projecting punch | 1 | 3 | 10 | 5 | 1.0 | 135 | 0.5 | 18.4 |
| 11 | 2.6 | Projecting punch | 1 | 3 | 10 | 5 | 1.0 | 135 | 0.5 | 39.8 |
| 12 | 2.6 | Projecting punch | 1 | 0.5 | 10 | 3 | 1.0 | 135 | 0 | 36.9 |
| 13 | 2.6 | Projecting punch | 1 | 0.5 | 10 | 3 | 0.3 | 135 | 0.5 | 42.3 |
| 14 | 2.6 | Projecting punch | 1 | 0.5 | 10 | 3 | 1.0 | 110 | 0 | 55.1 |
| 15 | 2.6 | Projecting punch | 1 | 0.7 | 10 | 3 | 2.5 | 110 | 0 | 39.9 |
| 16 | 2.6 | Projecting punch | 1 | 0.5 | 10 | 3 | 1.0 | 160 | 0 | 18.0 |
| 17 | 2.6 | Projecting punch | 1 | 5 | 10 | 2.5 | 1.0 | 160 | 0.2 | 17.6 |
| 18 | 2.6 | Projecting punch | 1 | 5 | 10 | 2.5 | 1.0 | 160 | 02 | 17.6 |
| 19 | 2.6 | Projecting punch | 1 | 0.5 | 10 | 0.5 | 1.0 | 135 | 0 | 18.4 |
| 20 | 2.6 | Projecting punch | 1 | 0.5 | 10 | 3 | 0.3 | 135 | 0 | 42.3 |
| 21 | 2.6 | Projecting punch | 1 | 0.5 | 10 | 3 | 1.0 | 135 | 0 | 36.9 |
| 22 | 2.6 | Projecting punch | 1 | 0.5 | 10 | 3 | 1.0 | 135 | 0 | 36.9 |
| 23 | 2.6 | Projecting punch | 1 | 0.5 | 10 | 3 | 1.0 | 135 | 0 | 36.9 |
| 24 | 2.6 | Projecting punch | 1 | 0.5 | 10 | 3 | 1.0 | 135 | 0 | 36.9 |
| 25 | 2.6 | Projecting punch | 1 | 0.5 | 10 | 3.5 | 1.5 | 135 | 0 | 35.0 |
| 26 | 2.6 | Projecting punch | 0.01 | 0.5 | 10 | 3.5 | 1.5 | 135 | 0 | 35.0 |
| 27 | 2.6 | Projecting punch | 0.01 | 0.5 | 10 | 3.5 | 1.5 | 135 | 0 | 35.0 |
| 28 | 2.6 | Projecting punch | 0.1 | 0.5 | 10 | 3.5 | 1.5 | 135 | 0 | 35.0 |
| 29 | 2.6 | Projecting punch | 5 | 0.5 | 10 | 3.5 | 1.5 | 135 | 0 | 35.0 |
| 30 | 2.6 | Projecting punch | 10 | 0.5 | 10 | 3.5 | 1.5 | 135 | 0 | 35.0 |

TABLE 1-continued

| | | | | | | | | | | |
|---|---|---|---|---|---|---|---|---|---|---|
| 31 | 2.6 | Projecting punch | 10 | 0.5 | 10 | 3.5 | 1.5 | 135 | 0 | 35.0 |
| 32 | 2.6 | Projecting punch | 1 | 0 | 10 | 3 | 1.0 | 135 | 0 | 36.9 |
| 33 | 2.6 | Projecting punch | 1 | 10 | 10 | 3 | 1.0 | 135 | 0 | 36.9 |
| 34 | 2.6 | Projecting punch | 1 | 0.5 | 20 | 0.5 | 1.0 | 135 | 0 | 18.4 |
| 35 | 1.2 | Projecting punch | 1 | 0.5 | 20 | 0.5 | 0.1 | 135 | 0 | 39.8 |
| 36 | 1.2 | Projecting punch | 1 | 0 | 20 | 0.5 | 0.1 | 135 | 0 | 39.8 |
| 37 | 5.0 | Projecting punch | 1 | 0.5 | 20 | 0.5 | 0.1 | 135 | 0 | 39.8 |
| 38 | 5.0 | Projecting punch | 1 | 10 | 20 | 0.5 | 0.1 | 135 | 0 | 39.8 |
| 39 | 2.6 | Projecting punch | 1 | 0.5 | 40 | 0.5 | 1.0 | 135 | 0 | 18.4 |
| 40 | 2.6 | Projecting punch | 1 | 0.5 | 40 | 0.5 | 1.0 | 135 | 0 | 18.4 |
| 41 | 2.6 | Projecting punch | 1 | 0.5 | 40 | 0.5 | 1.0 | 135 | 0 | 18.4 |
| 42 | 2.6 | Projecting punch | 1 | 0.5 | 50 | 0.3 | 1.0 | 135 | 0 | 13.0 |
| 43 | 2.6 | Projecting punch | 1 | 0.5 | 50 | 0.3 | 0.5 | 135 | 0 | 20.6 |
| 44 | 2.6 | Projecting punch | 1 | 0.5 | 50 | 0.3 | 1.0 | 135 | 0 | 13.0 |
| 45 | 2.6 | Projecting punch | 1 | 0.5 | 10 | 3 | 0.3 | 90 | 0.5 | 84.3 |
| 46 | 2.6 | Projecting punch | 1 | 0.5 | 10 | 1 | 0.3 | 135 | 0 | 37.6 |
| 47 | 2.6 | Projecting punch | 1 | 3 | 10 | 5 | 1.0 | 135 | 0.5 | 39.8 |
| 48 | 2.6 | Projecting punch | 1 | 3 | 10 | 5 | 1.0 | 135 | 0.5 | 39.8 |
| 49 | 2.6 | Projecting punch | 1 | 3 | 10 | 5 | 1.0 | 135 | 0.5 | 39.8 |

| | Level | Die shape | | | Hole expansion | | |
|---|---|---|---|---|---|---|---|
| | Sheet thickness (mm) | Die hole inside dia. Ad (mm) | Shoulder Rd (mm) | Clearance (%) | End face warping speed (1/sec) | Punching hole expansion ratio (%) | Remarks |
| 1 | 2.6 | 10.65 | 0.01 | 12.5 | 0.08 | 40 | Ref. ex. |
| 2 | 2.6 | 10.65 | 0.015 | 12.5 | 0.08 | 80 | Comp. ex. |
| 3 | 2.6 | 10.65 | 0.05 | 12.5 | 0.08 | 95 | Inv. ex. |
| 4 | 2.6 | 20.65 | 0.03 | 12.5 | 0.08 | 50 | Comp. ex. |
| 5 | 2.6 | 20.3 | 0.03 | 12.5 | 0.08 | 52 | Comp. ex. |
| 6 | 2.6 | 20.3 | 0.025 | 12.5 | 0.08 | 80 | Comp. ex. |
| 7 | 2.6 | 21.25 | 0.035 | 12.5 | 0.08 | 95 | Inv. ex. |
| 8 | 2.6 | 21.25 | 0.05 | 12.5 | 0.08 | 100 | Inv. ex. |
| 9 | 2.6 | 40.65 | 0.1 | 12.5 | 0.08 | 100 | Inv. ex. |
| 10 | 2.6 | 40.65 | 0.15 | 12.5 | 0.08 | 100 | Inv. ex. |
| 11 | 2.6 | 10.65 | 0.19 | 12.5 | 0.08 | 95 | Inv. ex. |
| 12 | 2.6 | 10.65 | 0.21 | 12.5 | 0.08 | 75 | Comp. ex. |
| 13 | 2.6 | 10.65 | 0.02 | 12.5 | 0.08 | 82 | Comp. ex. |
| 14 | 2.6 | 10.65 | 0.02 | 12.5 | 0.08 | 80 | Comp. ex. |
| 15 | 2.6 | 10.65 | 0.05 | 12.5 | 0.08 | 100 | Inv. ex. |
| 16 | 2.6 | 10.65 | 0.02 | 12.5 | 0.08 | 80 | Comp. ex. |
| 17 | 2.6 | 10.65 | 0.09 | 12.5 | 0.08 | 100 | Inv. ex. |
| 18 | 2.6 | 10.65 | 0.15 | 12.5 | 0.08 | 100 | Inv. ex. |
| 19 | 2.6 | 10.65 | 0.015 | 12.5 | 0.08 | 80 | Comp. ex. |
| 20 | 2.6 | 10.65 | 0.008 | 12.5 | 0.08 | 80 | Comp. ex. |
| 21 | 2.6 | 10.26 | 0.015 | 5.0 | 0.08 | 80 | Comp. ex. |
| 22 | 2.6 | 10.26 | 0.04 | 5.0 | 0.08 | 105 | Inv. ex. |
| 23 | 2.6 | 11.04 | 0.02 | 20.0 | 0.08 | 80 | Comp. ex. |
| 24 | 2.6 | 11.3 | 0.025 | 25.0 | 0.08 | 80 | Comp. ex. |
| 25 | 2.6 | 11.3 | 0.05 | 25.0 | 0.08 | 105 | Inv. ex. |
| 26 | 2.6 | 10.65 | 0.055 | 12.5 | 0.08 | 90 | Inv. ex. |
| 27 | 2.6 | 10.65 | 0.05 | 12.5 | 0.08 | 103 | Inv. ex. |
| 28 | 2.6 | 10.65 | 0.05 | 12.5 | 0.08 | 90 | Inv. ex. |
| 29 | 2.6 | 10.65 | 0.05 | 12.5 | 0.08 | 92 | Inv. ex. |
| 30 | 2.6 | 10.65 | 0.05 | 12.5 | 0.08 | 90 | Inv. ex. |
| 31 | 2.6 | 10.65 | 0.005 | 12.5 | 0.08 | 90 | Inv. ex. |
| 32 | 2.6 | 10.65 | 0.025 | 12.5 | 0.08 | 80 | Comp. ex. |
| 33 | 2.6 | 10.65 | 0.02 | 12.5 | 0.08 | 80 | Comp. ex. |
| 34 | 2.6 | 20.65 | 0.02 | 12.5 | 0.08 | 80 | Comp. ex. |
| 35 | 1.2 | 20.3 | 0.015 | 12.5 | 0.08 | 80 | Comp. ex. |
| 36 | 1.2 | 20.3 | 0.045 | 12.5 | 0.08 | 95 | Inv. ex. |
| 37 | 5.0 | 21.25 | 0.02 | 12.5 | 0.08 | 80 | Comp. ex. |
| 38 | 5.0 | 21.25 | 0.04 | 12.5 | 0.08 | 95 | Inv. ex. |
| 39 | 2.6 | 40.65 | 0.02 | 12.5 | 0.08 | 80 | Comp. ex. |
| 40 | 2.6 | 40.65 | 0.005 | 12.5 | 0.08 | 80 | Comp. ex. |
| 41 | 2.6 | 40.65 | 0.005 | 12.5 | 0.08 | 80 | Comp. ex. |
| 42 | 2.6 | 50.65 | 0.01 | 12.5 | 0.08 | 80 | Comp. ex. |
| 43 | 2.6 | 50.65 | 0.035 | 12.5 | 0.08 | 100 | Inv. ex. |
| 44 | 2.6 | 50.65 | 0.01 | 12.5 | 0.08 | 80 | Comp. ex. |
| 45 | 2.6 | 10.65 | 0.01 | 12.5 | 0.08 | 80 | Comp. ex. |
| 46 | 2.6 | 10.65 | 0.015 | 12.5 | 0.08 | 80 | Comp. ex. |
| 47 | 2.6 | 10.65 | 0.035 | 12.5 | 0.08 | 110 | Inv. ex. |
| 48 | 2.6 | 10.65 | 0.035 | 12.5 | 4.50 | 120 | Inv. ex. |
| 49 | 2.6 | 10.65 | 0.1 | 12.5 | 5.50 | Test not possible | Ref. ex. |

TABLE 2

| Level | Test conditions | | | | Punch shape | | | | | |
|---|---|---|---|---|---|---|---|---|---|---|
| | Sheet thickness (mm) | Die type | Punching speed (mm/sec) | Sheet holding load (tonf) | Punch dia. Ap (mm) | Projection height Hp (mm) | Distance between projection and cutting edge Dp (mm) | Projection shoulder angle (°) | Projection radius of curvatuve Rp (mm) | Angle α (°) |
| 8 | 2.6 | | 1 | 3 | 10 | 5 | 1 | 135 | 0.5 | 39.8 |
| 101 | 2.6 | | 1 | 3 | 10 | 5 | 1 | 135 | 0.5 | 39.8 |
| 102 | 2.6 | | 1 | 3 | 10 | 5 | 1 | 135 | 0.5 | 39.8 |
| 103 | 2.6 | Projecting punch | 1 | 3 | 10 | 5 | 1 | 135 | 0.5 | 39.8 |

| Level | Die shape | | | | | | Hole expansion | | |
|---|---|---|---|---|---|---|---|---|---|
| | Sheet thickness (mm) | Die hole inside dia. Ad (mm) | Shoulder R1 R1 (mm) | Should R2 R2 (mm) | Angle β (°) | Clearance (%) | End face warping speed (1/sec) | Punching hole expansion ratio | Remarks |
| 8 | 2.6 | 10.65 | 0.05 | | | 12.5 | 0.08 | 100 | Inv. ex. |
| 101 | 2.6 | 10.65 | 0.05 | 0.21 | 30 | 12.5 | 0.08 | 102 | Inv. ex. |
| 102 | 2.6 | 10.65 | 0.05 | 0.21 | 45 | 12.5 | 0.08 | 105 | Inv. ex. |
| 103 | 2.6 | 10.65 | 0.05 | 0.21 | 75 | 12.5 | 0.08 | 106 | Inv. ex. |

INDUSTRIAL APPLICABILITY

The present invention can be utilized for a punching tool of a steel sheet. In particular, it exhibits its effect in 800 MPa or more high strength steel sheet enabling utilization for auto parts etc.

REFERENCE SIGNS LIST

1. punch
2. die
3. sheet holder
4. worked material
5. crack
A. punch projection
Ad. die hole inside diameter
Ap. punch diameter
B. punch cutting edge (shoulder)
Bp. projection bottom surface part
C. punch-die clearance
Dp. PQ clearance
Hp. projecting height
M. material cutting part
O1. center of curvature of R1 of two-stage shoulder R
O2. center of curvature of R2 of two-stage shoulder R
P. punch cutting edge end
Rp. radius of curvature of projecting shoulder
Rd. radius of curvature of die shoulder
R1. radius of curvature of punch side of two-stage shoulder R
R2. radius of curvature of opposite side to punch of two-stage shoulder R
Q. projection rising part
T. intersection of arcs of R1 and R2 (contact point)
Wp. projection vertical wall
t. sheet thickness of worked material
θp. projection vertical wall angle
α. angle formed by tangent from punch cutting edge end to projection shoulder and direction perpendicular to direction of movement of punch
β. angle formed by line passing through centers of curvature of R1, R2 and direction perpendicular to direction of movement of punch

The invention claimed is:

1. A method of punching a steel sheet using tooling for punching comprised of at least a die, a sheet holder, and a projecting punch, in which method of punching a steel sheet, in a cross-section parallel to a direction of movement of the punch and vertical to a ridgeline formed by a cutting edge of the punch or a cutting edge of the die, the radius of curvature R of a shoulder forming the cutting edge of the die is from 0.03 mm to 0.2 mm and an angle α formed by a line drawn from the shoulder forming the cutting edge of the punch to the shoulder of the projection and a direction perpendicular to the direction of movement of the punch is from 12° to 72°, wherein the curvature of the shoulder forming the cutting edge of said die is comprised of two radii of curvature, the radius of curvature of the curve facing the punch being R1, and the radius of curvature of the other curve being R2, and when the angle formed by the line passing through the intersection of the two curves based on R1 and R2 and the center of curvature of R1 with the direction perpendicular to the direction of movement of the punch is β and the thickness of the steel sheet is "t", $0.03\ \text{mm} \leq R1 \leq 0.2\ \text{mm}$ $1 < R2/R1$ $30° \leq \beta \leq 90°$ where, the units of R1, R2, and "t" are all mm.

2. The method of punching a steel sheet according to claim 1 wherein further said two radii of curvature R1 and R2 satisfy $1 \leq R2/R1 \leq 7$ and $R2(1-\sin\beta) \leq 3t$.

3. Tooling for punching a steel sheet comprised of at least a die, a sheet holder, and a projecting punch, in which tooling for punching a steel sheet, in a cross-section parallel to a direction of movement of the punch and vertical to a ridgeline formed by a cutting edge of the punch or a cutting edge of the die, the radius of curvature R of a shoulder forming the cutting edge of the die is from 0.03 mm to 0.2 mm and an angle α formed by a line drawn from the shoulder forming the cutting edge of the punch to the shoulder of the projection and a direction perpendicular to the direction of movement of the punch is from 12° to 72°, wherein the curvature of the shoulder forming the cutting edge of said die is comprised of two radii of curvature, the radius of curvature of the curve facing the punch being R1, and the radius of curvature of the other curve being R2, and when the angle formed by the line passing through the intersection of the two curves based on R1 and R2 and the center of curvature of R1 with the direction perpendicular to the direction of movement of the punch is β and the thickness of the steel sheet is "t", $0.03\ \text{min} \leq R1 \leq 1\ \text{mm}$ $1 < R2/R1$ $30° \leq \beta \leq 90°$ where, the units of R1, R2, and "t" are all mm.

4. The tooling for punching a steel sheet according to claim 1, wherein further said two radii of curvature R1 and R2 satisfy $1 \leq R2/R1 \leq 7$ and $R2(1-\sin\beta) \leq 3t$.

* * * * *